US010813482B2

(12) United States Patent
Oliver

(10) Patent No.: US 10,813,482 B2
(45) Date of Patent: Oct. 27, 2020

(54) PORTABLE MATTRESS SEATING APPARATUS

(71) Applicant: Jonathan Oliver, Sunderland (GB)

(72) Inventor: Jonathan Oliver, Sunderland (GB)

( * ) Notice: Subject to any disclaimer, the term of this patent is extended or adjusted under 35 U.S.C. 154(b) by 0 days.

(21) Appl. No.: 16/386,567

(22) Filed: Apr. 17, 2019

(65) Prior Publication Data

US 2019/0335912 A1 Nov. 7, 2019

Related U.S. Application Data

(60) Provisional application No. 62/666,038, filed on May 2, 2018.

(51) Int. Cl.

| | |
|---|---|
| ***A47C 20/02*** | (2006.01) |
| ***A47C 15/00*** | (2006.01) |
| ***A47C 16/00*** | (2006.01) |
| ***A47G 9/10*** | (2006.01) |
| *A47G 9/00* | (2006.01) |
| *A47G 9/02* | (2006.01) |

(52) U.S. Cl.

CPC ..... *A47G 9/1036* (2013.01); *A47G 9/10* (2013.01); *A47G 9/1054* (2013.01); *A47C 20/02* (2013.01); *A47G 9/00* (2013.01); *A47G 9/0253* (2013.01); *A47G 2009/1018* (2013.01)

(58) Field of Classification Search

CPC .... A47C 1/16; A47C 3/16; A47C 7/42; A47C 7/425; A47C 16/00; A47C 16/005; A47C 15/004; A47C 20/027; A47C 20/028

See application file for complete search history.

(56) References Cited

U.S. PATENT DOCUMENTS 591,099 A * 10/1897 Harbaugh ..... A47C 20/027 5/634
645,878 A * 3/1900 Tennyson ..... A47C 1/16 297/252
1,054,169 A * 2/1913 Brott ..... A47C 1/16 297/252
2,131,609 A * 9/1938 Alexander ..... A47C 20/027 248/231.41
2,529,350 A * 11/1950 Posz ..... A47C 20/027 5/633
2,542,820 A * 2/1951 Legois ..... A47C 1/16 297/351
2,722,693 A * 11/1955 Wolf ..... A47C 20/027 5/426
2,816,871 A * 12/1957 Fish ..... A47C 1/16 297/217.1

(Continued)

*Primary Examiner* — Timothy J Brindley
(74) *Attorney, Agent, or Firm* — Capehart Law Firm

(57) ABSTRACT

A portable mattress seating apparatus attachable to a mattress. The portable mattress seating apparatus clips onto a location on the peripheral of any conventional mattress. The apparatus has a retaining member that is retained under a mattress and above the box spring. The retaining member is attached to a vertical member adjacent to the side of the mattress. The vertical member is attached to another seating member that is oriented parallel to the top of the mattress face. The seat member is attached to a back-rest member. The back-rest member is attached to the seating member distal to the side of the mattress. The back-rest member is adjustable, allowing the back rest to be at acute, obtuse or 90-degree angles to the seating member. Further, the apparatus includes supporting members to spread the weight of a seated person.

5 Claims, 8 Drawing Sheets

(56) References Cited

U.S. PATENT DOCUMENTS 2,957,515 A * 10/1960 Gibson ..... A47C 4/18 297/252
3,022,524 A * 2/1962 Hultquist ..... A47C 7/42 441/126
3,026,142 A * 3/1962 Holloway ..... A47C 1/16 297/252
3,299,448 A * 1/1967 Rucchio ..... A47C 5/10 5/633
3,343,185 A * 9/1967 Nemser ..... A47C 20/027 5/633
3,594,039 A * 7/1971 Harp ..... A47C 1/16 297/252
3,720,965 A * 3/1973 Wright ..... A47C 20/027 297/352
5,765,244 A * 6/1998 Heidler ..... A47C 20/027 5/630
6,203,108 B1 * 3/2001 Mattison, Jr. ..... A47C 1/16 297/252
6,374,440 B1 * 4/2002 Thim, Jr. ..... A47C 20/027 5/426
7,758,119 B1 * 7/2010 Baterdouk ..... A47C 7/72 297/217.6
8,459,738 B2 * 6/2013 Downey ..... A47C 7/42 297/230.1
10,398,613 B2 * 9/2019 Harburg ..... A61G 7/0755
2005/0251918 A1 * 11/2005 Lary ..... A47C 20/021 5/634
2006/0220428 A1 * 10/2006 Vestweber ..... A47C 1/16 297/252
2009/0100596 A1 * 4/2009 Weedling ..... A47C 20/027 5/81.1 HS
2009/0254011 A1 * 10/2009 Chi ..... A47C 7/72 601/134
2013/0033074 A1 * 2/2013 Daly ..... A47C 1/146 297/183.1

* cited by examiner

PORTABLE MATTRESS SEATING APPARATUS

REFERENCE TO PENDING APPLICATIONS

This application claims the benefit of U.S. Provisional Patent Application Ser. No. 62/666,038, entitled PORTABLE MATTRESS SEATING APPARATUS file on May 2, 2018.

BACKGROUND OF THE INVENTION

1. Field of the Invention

The present invention relates generally to the field of seating and more specifically relates to a mattress seating apparatus.

2. Description of the Related Art

Presently, seating is available for almost every room in a home. Chairs and sofas and other like pieces of furniture are designed to allow a person to rest their upper body on a vertical support while in a seated position. These pieces of furniture also include arm rests where a user may place their forearms or elbows for increased support while sitting. With few exceptions, the structure of conventional seating arrangements is fixed in one position. The nature of the fixed structure makes moving these seating arrangements cumbersome. Often the passageway leading to a residence is size prohibitive for a conventional piece of furniture. Large chairs and sofas must be disassembled to travel a narrow staircase or pass through a door.

There are pieces of furniture, however, rather than being stationary, are designed to be portable. The portable chair can be found in as a part of camping equipment. Portable chairs generally have numerous pivot points and at least double that number of rigid members. Other less common portable chairs include locking telescopic members. The telescopic members may be expanded for use and retracted for portability. Even less commonly used are modularly assembled portable seats. The modularly assembled seating requires as much effort to assemble as to disassemble. Further, the modular seating involves storing and organization of the individual pieces that if lost, render the entire assembly useless.

The discussed portable seating arrangement options require a viable floor space for use. To utilize existing options, accommodating real estate must be allocated. Still, given that the appropriate floor space may be allocated, current portable seating art is typically unsightly and does not provide a warm home décor. Further, traveling with existing portable seating art may be cost prohibitive due to the sheer volume and weight of conventional portable seating art. A suitable solution is required.

Various attempts have been made to solve problems found in seating art. Among these are found in: U.S. Pat. Nos. 3,343,185, 2,529,350, 2,867,821, and 2,448,924. This prior art is representative of a mattress seating apparatus.

None of the above inventions and patents, taken either singly or in combination, is seen to describe the invention as claimed. Thus, a need exists for a reliable mattress seating apparatus, and to avoid the above-mentioned problems.

BRIEF SUMMARY OF THE INVENTION

The present invention advantageously fills the aforementioned deficiencies by seating art. The present invention is superior to other systems in that it effectively provides a portable seating for a mattress.

The present invention provides a portable mattress seating apparatus that may be attached to a mattress. The present invention effectively clips onto a location on the peripheral of any conventional mattress. The apparatus has a retaining member that is retained under a mattress and above the box spring. The retaining member is attached to a vertical member adjacent to the side of the mattress.

The vertical member is attached to another seating member that is oriented parallel to the top of the mattress face. The seat member is attached to a back-rest member. The back-rest member is attached to the seating member distal to the side of the mattress. The back-rest member is adjustable, allowing the back rest to be at acute obtuse or 90-degree angles to the seating member. Further, the apparatus includes supporting members to spread the weight of a seated person.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention, portable mattress seat, constructed and operative according to the teachings of the present invention.

The various embodiments of the present invention will hereinafter be described in conjunction with the appended drawings, wherein like designations denote like elements.

DETAILED DESCRIPTION

The present invention is directed to a portable mattress seating apparatus. The present invention effectively clips onto a location on the peripheral of any conventional mattress. The apparatus has a retaining member that is retained under a mattress and above the box spring.

In an embodiment, the retaining member is oriented parallel to the planes of the bottom face of the mattress and the top face of the box spring. The retaining member may comprise of a left retaining member and a right retaining member. The retaining member is attached to a vertical member adjacent to the side of the mattress.

The vertical member may comprise of a left vertical member, and a right vertical member. The left and right vertical members may be pivotably attached to the respective side members of the retaining member. The vertical member is attached to a seating member that is oriented parallel to the top of the mattress face.

The seating member may comprise a left seating member and a right seating member. The left seating member and the right seating member pivotably attached to the respective vertical members. Between the left seating member and the right seating member may be a material configured for a user to sit on.

The material may be a cushion, or a stretched piece of fabric. The seat member is attached to a back-rest member. The back-rest member may comprise a left back rest member, a right back rest member and a top back rest member. The left back rest member and the right back rest member may be pivotably attached to the respective seating members. The top back rest member may be attached to the ends of the left back rest member and the right back rest member distal to the seating member. The back-rest member may be attached to the seating member distal to the side of the mattress.

Between the right back rest member and the left back rest member may be a taught piece of fabric configured to retain the weight of a person. The back-rest member may be adjustable, allowing the back rest to be at acute or obtuse angles to the seating member. Further the apparatus includes supporting members to spread the weight of a seated person.

In one embodiment of the present invention, the portable mattress seating apparatus may comprise weight spreading attachments. The weight spreading attachments may attach to the seat member in parallel orientation to the mattress face. The weight spreading attachments may be configured to distribute the weight of a user in a seated position on the portable mattress seating apparatus to a larger area of the mattress. This distribution of weight may prevent the face of the mattress from becoming concave from due to the weight of a person seated in the portable mattress seating apparatus.

Figure 1:
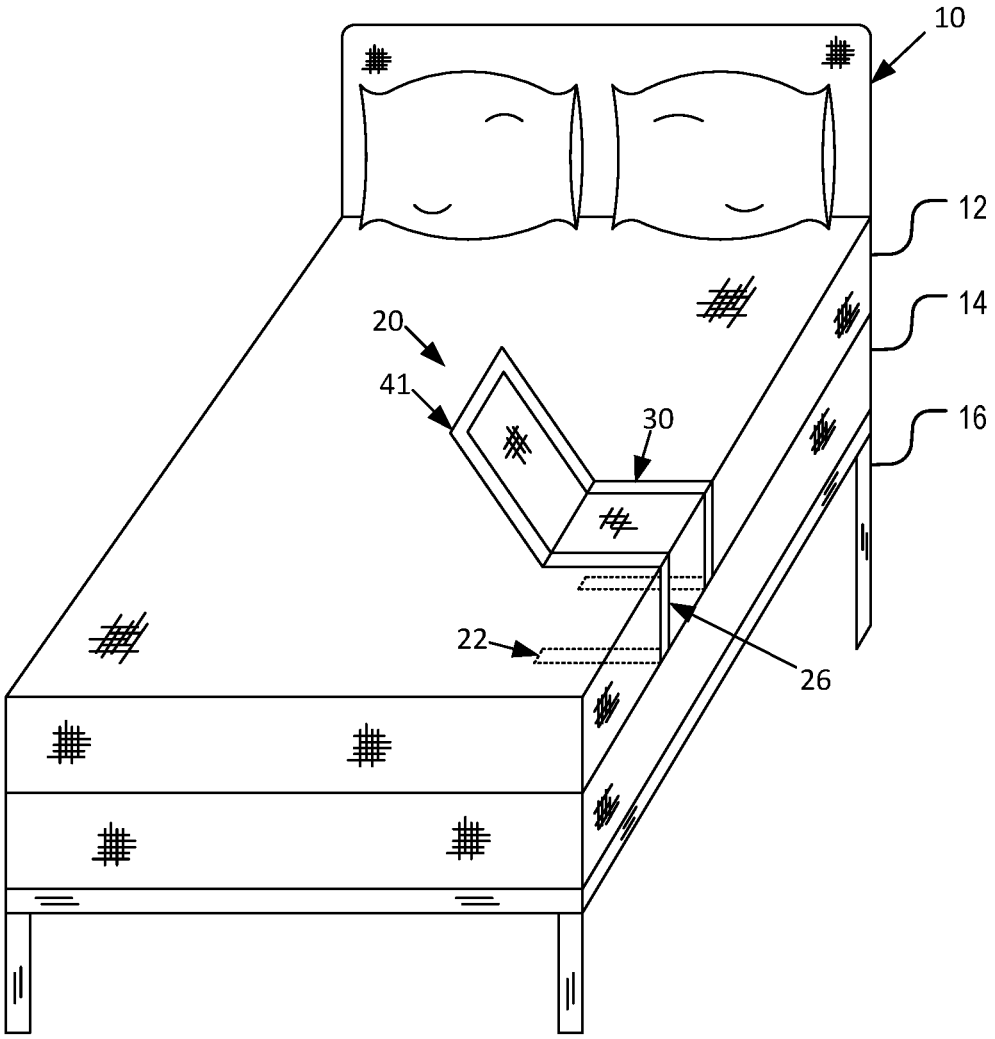
FIG. 1 is a perspective view of a portable mattress seating apparatus system during an 'in-use' condition showing the portable mattress seating apparatus according to an embodiment of the present invention.
Figure 2:
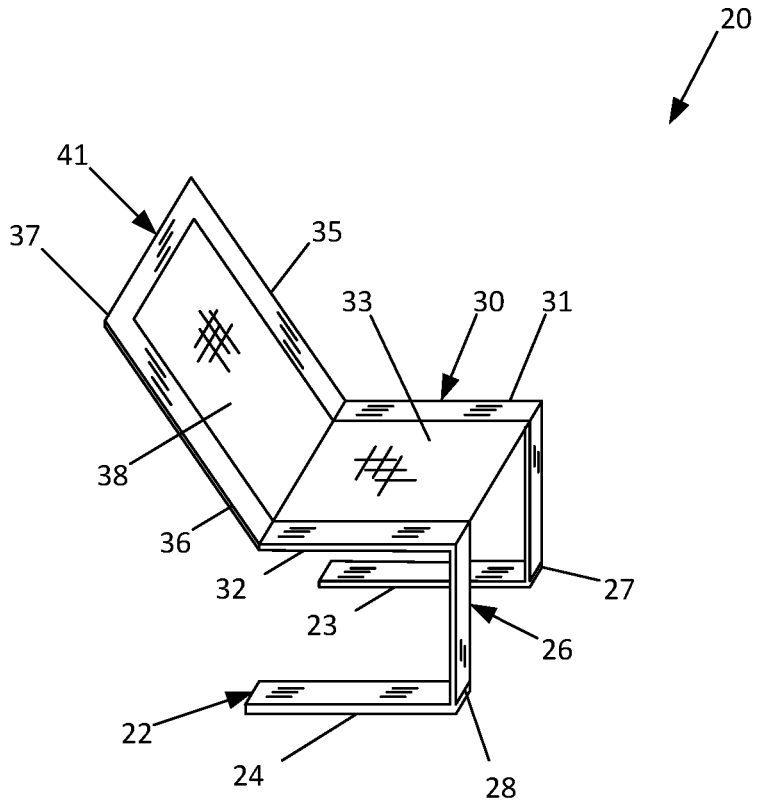
FIG. 2 is a perspective view of a portable mattress seating apparatus system according to an embodiment of the present invention.

As illustrated in FIGS. 1 and 2, an embodiment of the present invention is illustrated. As shown, the portable mattress seating apparatus 20 may comprise a retaining member 22, a vertical member 26, a seating member 30 and a back-rest member 41. Apparatus 20 is configured to be used with a bed 10 having a mattress 12 and a box-spring 14. In use, the retaining member 22 is placed between mattress 12 and box spring 14. Box spring 14 is shown to be supported by a bed frame 16. This is illustrative and not meant to be limiting. Further, apparatus may be utilized with only a single mattress, two mattresses where none of which are considered to be a box spring, and with a mattress that is supported only by a bed frame.

Figure 3:
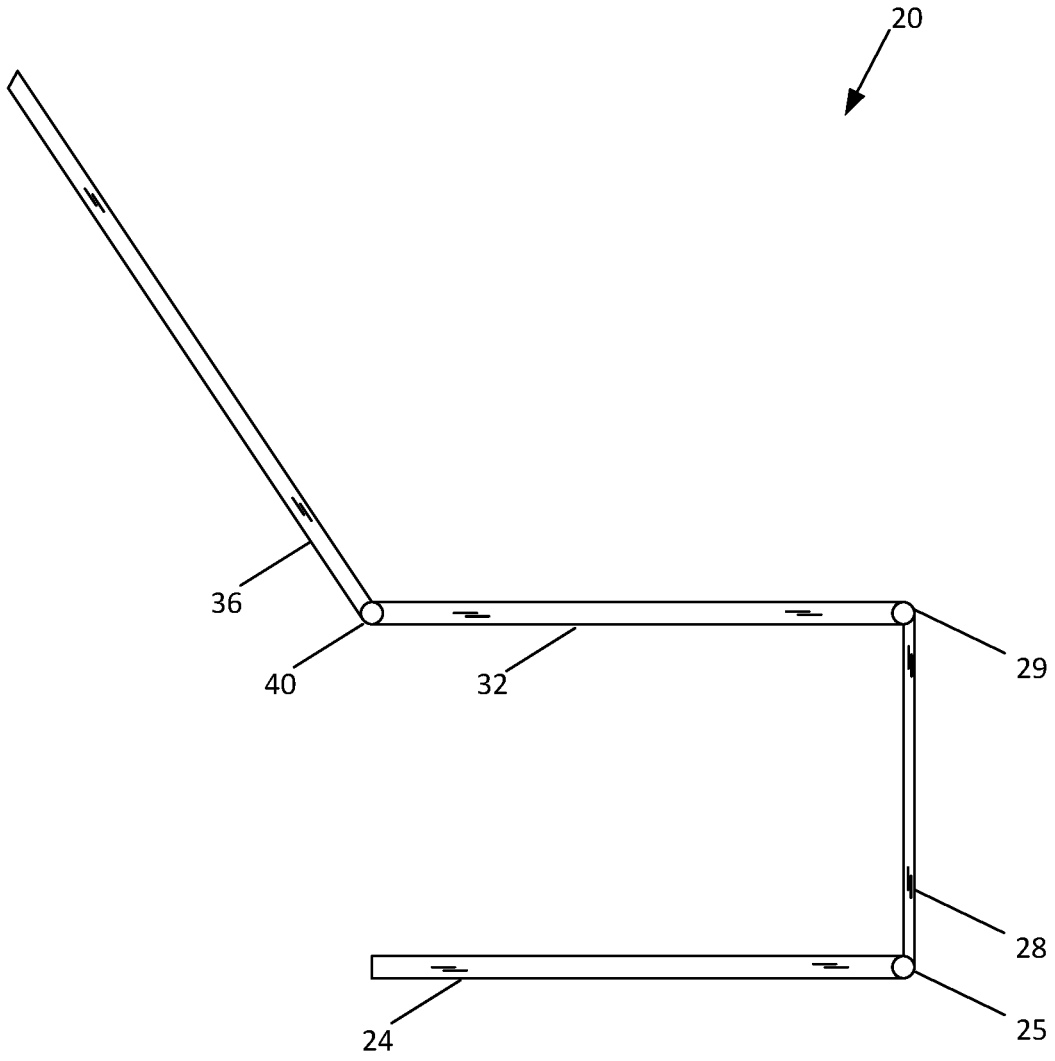
FIG. 3 is a side view of a portable mattress seating apparatus system according to an embodiment of the present invention.

The retaining member 22 may comprise of a left retaining member 24 and a right retaining member 23 that is located distal from and substantially parallel to the left retaining member 24. The retaining member 22 is attached to a vertical member 26 adjacent to the side of the mattress 12. The vertical member 26 may comprise of a left vertical member 28 and a right vertical member 27. The left and right vertical members 28, 27 may be pivotably attached by a first pivot element 25 to the respective side members 23, 24 of the retaining member 22, as illustrated in FIG. 3. In some embodiments, the retaining member 22 and the vertical member 26 may create no greater than a 90-degree angle therebetween.

Figure 4:
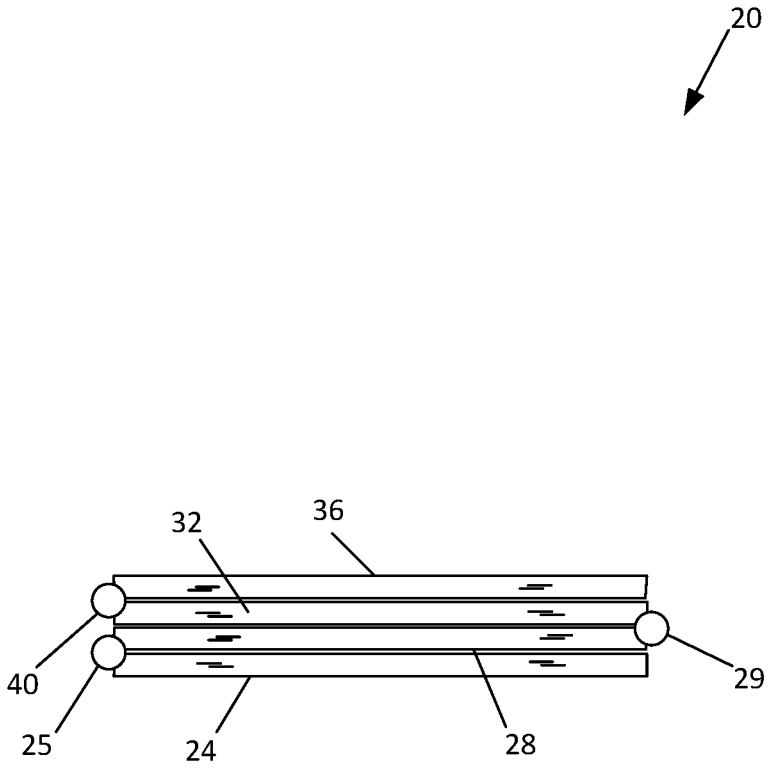
FIG. 4 is a side view of a portable mattress seating apparatus system in the closed position according to an embodiment of the present invention.

The vertical member 26 is attached to a seating member 30 that is oriented parallel to the top of the mattress face 12. The seating member 30 may comprise a left seating member 32 and a right seating member 31. The left seating member 32 and the right seating member 31 may be pivotably attached by a second pivot element 29 to the respective vertical members 27, 28, as illustrated in FIG. 3. In some embodiments, the vertical member 26 and the seating member 30 may create no greater than a 90-degree angle therebetween. In some embodiments, first pivot element 25 and second pivot element 29 may be configured to allow retaining member 22 and the vertical member 26 to fold flat against seating member 30 and vertical member 26, respectively, as illustrated in FIG. 4.

Figure 5:
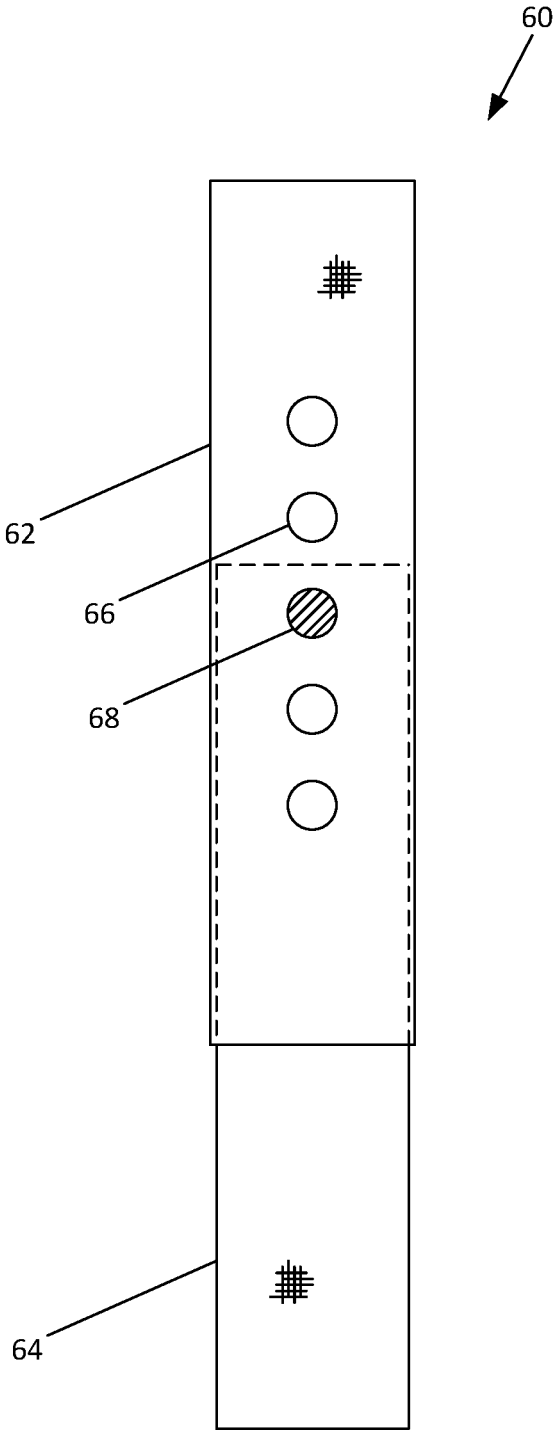
FIG. 5 is a front view of an embodiment of the vertical member of the present invention.
Figure 6:
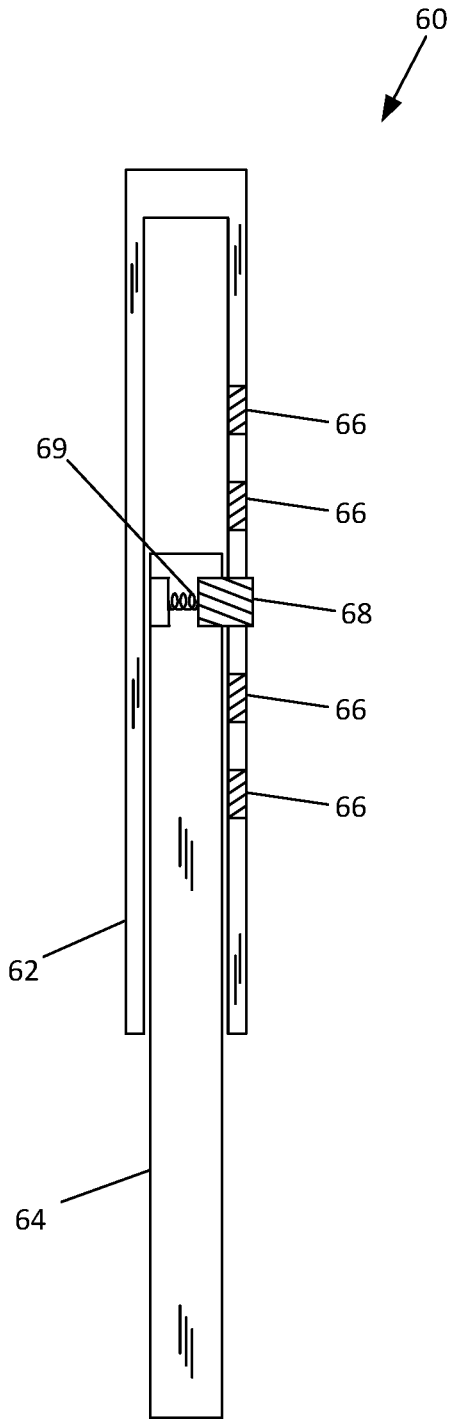
FIG. 6 is a side view of an embodiment of the vertical member of the present invention.

In some embodiments, vertical member 26 may be adjustable in order to accommodate mattresses having different thicknesses. An embodiment of an adjustable vertical member 60 is illustrated in FIGS. 5 and 6. In this embodiment, vertical member 60, which could be a right or left vertical member, includes an upper vertical member 62 and a lower vertical member 64. Upper vertical member 62 includes a plurality of adjustment openings 66 and is configured to receive lower vertical member 64 therein while lower vertical member 64 is configured to be inserted within upper vertical member 62. Upper vertical member 64 includes an adjustment element 68. Tension for adjustment element 68 is provided by a spring 69. In operation, lower vertical member 64 is placed within upper vertical member 62. Adjustment element 68 is depressed until the desired length is reached. Adjustment element 68 is released allowing it to be inserted into the desired adjustment opening 66.

Between the left seating member 32 and the right seating member 31 may be a seating material 33 configured for a user to sit on. The seating material 33 may be a cushion, or a stretched piece of fabric.

The seat member 30 is attached to a back rest member 41. The back rest member 41 may comprise a left back rest member 36, a right back rest member 35 and a top back rest member 37. The left back rest member 36 and the right back rest member 37 may be pivotably attached by an adjustment mechanism 40 to the respective seating members 31, 32. The adjustment mechanism 40 may allow a user to adjust the angle between the two members and lock back rest member 41 at a desired angle. In some embodiments, adjustment mechanism 40 may include a coil spring reclining mechanism which will provide tension in order to assist the back rest member 41 in maintaining the desired angle. In some embodiments, adjustment mechanism 40 may be configured to allow back rest member 41 close over top of seating member 30, as illustrated in FIG. 4.

The top back rest member 37 may be attached to the ends of the left back rest member 36 and the right back rest member 35 distal to the seating member 30. The back rest member 41 may be attached to the seating member 30 distal to the side of the mattress 12.

Between the right back rest member 35 and the left back rest member 36 may be a back rest material 38 configured to retain the weight of a person. The back rest material 38 may be a stretched piece of fabric.

Figure 7:
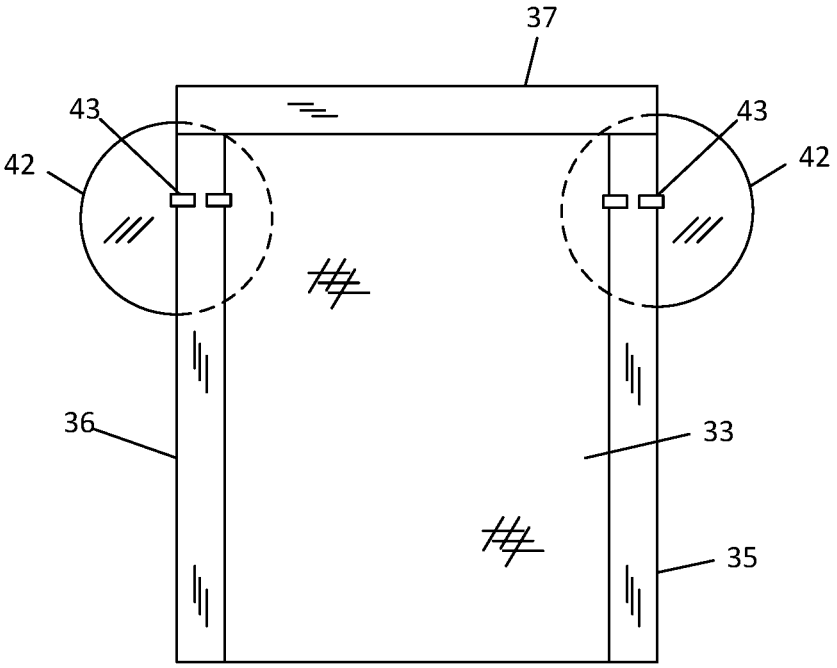
FIG. 7 is a top view of an embodiment of a weight distribution element of the present invention.

As illustrated in FIG. 7, an embodiment of present invention includes weight spreading attachments 42. The weight spreading attachments 42 may attach by attachments 43 to the right and left seat members 35, 36 in parallel orientation to the mattress face 12. The weight spreading attachments 42 may be configured to distribute the weight of a user in a seated position on the portable mattress seating apparatus 20 to a larger area of the mattress 12. This distribution of weight may prevent the face of the mattress 12 from becoming concave from due to the weight of a person seated in the portable mattress seating apparatus 20.

Figure 8:
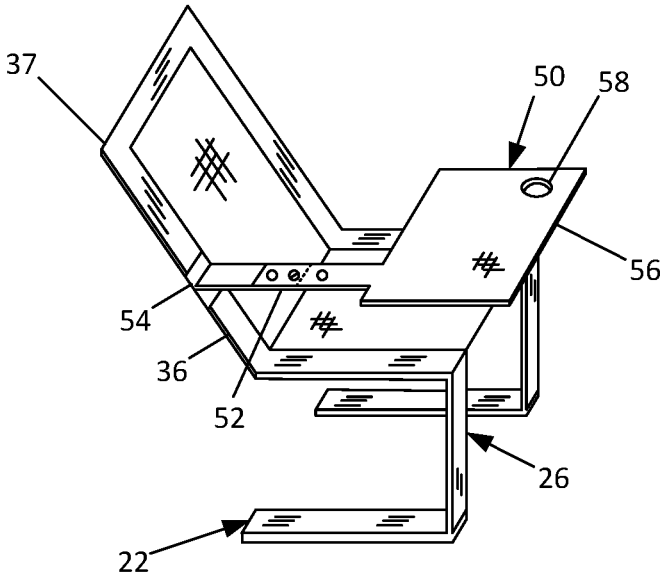
FIG. 8 is a perspective view of an embodiment of the present invention having an extendable table attachment.

As illustrated in FIG. 8, an embodiment of the present invention includes an adjustable table member 50. Table member 50 includes an adjustable arm member 52 and a table base member 56. In this embodiment, adjustable arm member 52 is secured to left back rest member 36 by a table connector 54. Those skilled in the art will recognize this is illustrative as table member 50 may also be connected to a right back rest member 35.

Table connector 54 is configured to be located at various locations along the left back rest member 36 in order to accommodate individuals of different sizes. Further, adjustable arm member 52 may be adjustable to extend outward from the left back rest member 36 in order to accommodate individuals having different sizes. The adjustment mechanisms for both the table connector 54 and adjustment arm member 52 may be an adjustment mechanism similar to that described above in reference to vertical member 60 or other similar type of adjustment mechanism.

Table base 50 is attached to adjustment arm member 52 and is configured to act as a table surface. In some embodiments, a cup holder 58 may be located within table base 50.

Figure 9:
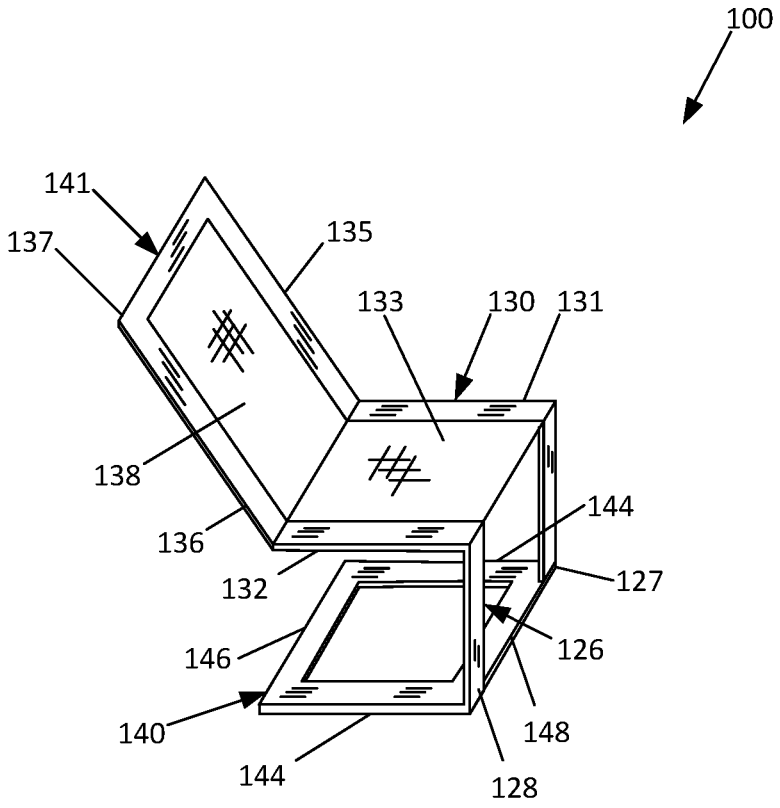
FIG. 9 is a perspective view of an additional embodiment of the portable mattress seating apparatus system of the present invention.

As illustrated in FIG. 9, an additional embodiment of the present invention is illustrated. As shown, the portable mattress seating apparatus 100 may comprise a retaining member 140, a vertical member 126, a seating member 130 and a back-rest member 141.

The retaining member 140 may comprise of a left retaining member 142, a right retaining member 144, a back retaining member 146 and a front retaining member 148. The retaining member 140 is attached to a vertical member 126 adjacent to the side of a mattress. The vertical member 126 may comprise of a left vertical member 128 and a right vertical member 127. The vertical member 126 is attached to a seating member 130 that is oriented parallel to the top of a mattress face. The seating member 130 may comprise a left seating member 132 and a right seating member 131.

Between the left seating member 132 and the right seating member 131 may be a seating material 133 configured for a user to sit on. The seating material 133 may be a cushion, or a stretched piece of fabric.

The seat member 130 is attached to a back rest member 141. The back rest member 141 may comprise a left back rest member 136, a right back rest member 135 and a top back rest member 137. Between the right back rest member 135 and the left back rest member 136 may be a back rest material 138 configured to retain the weight of a person. The back rest material 138 may be a stretched piece of fabric.

The exact specifications, materials used, and method of use of the portable mattress seating apparatus may vary upon manufacturing.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

I claim:

1. A portable mattress seating apparatus for use with a mattress having a mattress side wall and a mattress top face, the apparatus comprising:

a left retaining member configured to be placed under the mattress;

a right retaining member configured to be placed under the mattress and located distal from and substantially parallel to the left retaining member;

a left vertical member attached to the left retaining member and configured to be placed against the side wall of the mattress, the left vertical member having a left upper vertical member having a plurality of left adjustment openings; and a left lower vertical member having a left adjustment element, the left lower vertical member being configured to be inserted into the left upper vertical member, the left adjustment element being configured to engage one of the plurality of left adjustment openings;

a right vertical member located distal from and substantially parallel to the left vertical member, the right vertical member attached to the right retaining member and configured to be placed against the side wall of the mattress, the right vertical member having a right upper vertical member having a plurality of right adjustment openings, and a right lower vertical member having a right adjustment element, the right lower vertical member being configured to be inserted into the right upper vertical member, the right adjustment element being configured to engage one of the plurality of right adjustment openings, each of the left and right vertical members being connected to the left and right retaining members by a first pivot element and being configured to allow the left and right retention member to be pivotally attached to the left and right vertical member;

a left seating member attached to the left upper vertical member and configured to be placed against and substantially parallel to the mattress top face;

a right seating member located distal from and substantially parallel to the left seating member, the right seating member attached to the right upper vertical member and configured to be placed against and substantially parallel to the mattress top face, each of the left and right upper vertical members being connected to the left and right seating members by a second pivot element and being configured to allow the left and right seating members to be pivotally attached to the left and right upper vertical members;

a seating material located between the left seating member and the right seating member;

a left back rest member attached to the left seating member;

a right back rest member located distal from and substantially parallel to the left back rest member; a right back rest member attached to the right seating member, each of the left and right back rest members being connected to the left and right seating members by an adjustment mechanism and being configured to allow the angle between left and right back rest members and the left and right seating members to be adjusted;

a top back rest member located distal from the left and right seating members and between and substantially perpendicular to the right and left back rest members; and a back rest material located between the left, right and top back rest members.

2. The apparatus of claim 1, wherein the retaining member comprises:

a back retaining member located between and substantially perpendicular to the left and right retaining members;

a front retaining member located distal from and substantially parallel to the back retaining member, the front retaining member being attached to the vertical member, the left, right, back and front retaining members being in a rectangular configuration.

3. The apparatus of claim 1, further comprising a weight spreading attachment attached to the seating member.

4. The apparatus of claim 1, further comprising a table member attached to either the left or right back rest member.

5. The apparatus of claim 4, wherein the table member is further defined as having a table base attached to an extension arm, the extension arm attached to either the left or right back rest member, the extension arm configured to be adjustable.

* * * * *